United States Patent [19]

Saint-Cricq

[11] Patent Number: 4,846,478

[45] Date of Patent: Jul. 11, 1989

[54] INSTALLATION FOR THE GAME AND THE PRACTICING OF GOLF

[76] Inventor: Jacques Saint-Cricq, 3, Les Pinsons, 78170 La Celle Saint Cloud, France

[21] Appl. No.: 140,235

[22] Filed: Dec. 31, 1987

[30] Foreign Application Priority Data

Jan. 8, 1987 [FR] France ..... 87 00127

[51] Int. Cl.[4] ..... A63B 67/02; A63B 57/00; A63B 69/36

[52] U.S. Cl. ..... 273/176 A; 273/178 B; 273/182 R; 273/182 A; 273/179 C

[58] Field of Search ..... 273/176 R, 176 A, 176 B, 273/176 E, 176 K, 179 R, 179 C, 182 R, 182 A, 34 R, 34 A, 178 B

[56] References Cited

U.S. PATENT DOCUMENTS

| | | | |
|---|---|---|---|
| 3,129,943 | 4/1964 | McKee | 273/179 C X |
| 3,488,057 | 1/1970 | Fussell, Jr. et al. | 273/179 R X |
| 3,599,980 | 8/1971 | Harmond et al. . | |
| 3,863,922 | 2/1975 | Peeples . | |
| 4,202,547 | 5/1980 | Mueller | 273/182 R X |

FOREIGN PATENT DOCUMENTS

| | | | |
|---|---|---|---|
| 2339417 | 8/1977 | France . | |
| 52-17928 | 2/1977 | Japan | 273/182 R |
| 2169211 | 7/1986 | United Kingdom | 273/176 R |

*Primary Examiner*—Edward K. Look
*Assistant Examiner*—Mark A. Williamson
*Attorney, Agent, or Firm*—Wenderoth, Lind & Ponack

[57] ABSTRACT

An installation includes at least one starting head and at least one green provided with a hole, a device for recovering balls from the green and in the vicinity of the green, and an arrangement for returning the balls to the starting head. The installation further includes an arrangement enabling the player to evaluate the precision of his strokes and measure his skill alone or with respect to other players.

22 Claims, 5 Drawing Sheets

FIG.1
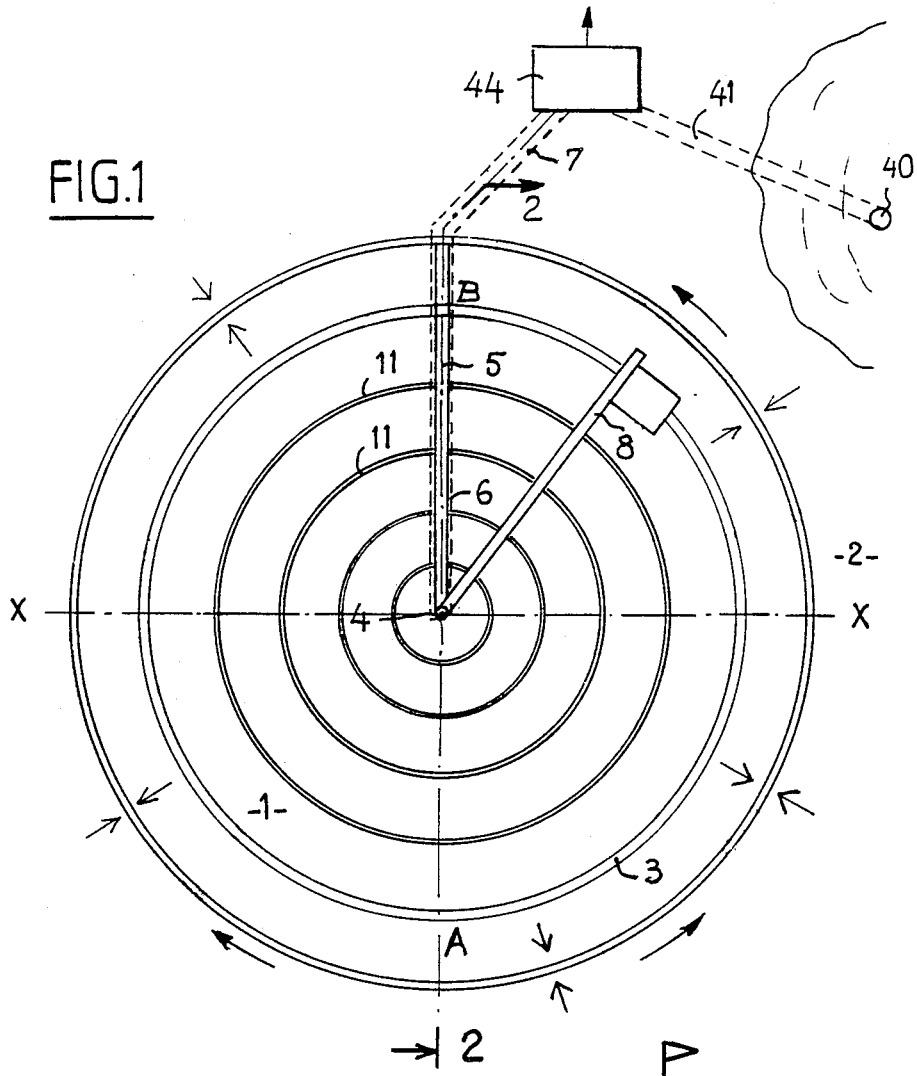
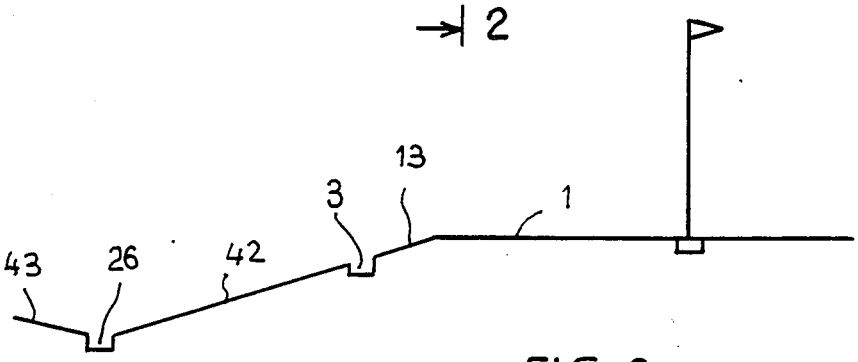
FIG. 8

INSTALLATION FOR THE GAME AND THE PRACTICING OF GOLF

BACKGROUND OF THE INVENTION

The present invention relates to an installation for the game and the practicing of golf and more particularly with regard to a shot or stroke for hitting or sending a golf ball onto a green or into a hole thereof.

Golf training installations or "practices" are known in which the players may improve their technique and more particularly their movements and their striking power. These practices however do not permit a measurement of the precision of a stroke relative to a precise objective.

SUMMARY OF THE INVENTION

An object of the invention is to provide an installation which permits an improvement in the conditions in which players may start or train for the practice of golf and a measurement of their skill relative to a precise object.

The invention therefore provides an installation for the game and the practising of golf comprising at least one starting head or tee position and at least one green provided with a hole, a device for recovering balls located on the green and in the vicinity of the green, and means for returning the balls to the starting head, the ball recovering device comprising a rake mounted to be movable in a direction parallel to the surface of the green so as to cover the entire area thereof, the rake having a lower edge located at a distance from the surface of the green which is less than the diameter of a ball, a device for driving the rake and means for receiving the balls moved by the rake, wherein the rake extends radially from the axis of the hole of the green, is mounted to be rotatable at one end about an axis coinciding with the axis of the hole, and carries in the vicinity of its outer end at least one rolling member bearing on a rolling track.

According to other features of the invention:

the practising device comprises a motor speed-reducer unit driving the rake in rotation about the axis of the hole of the green, the unit being located in a cavity in the vicinity of the axis of the hole and below the level of the green;

the means for receiving the balls comprise a trough located at the periphery of the green and a discharge pipe downwardly inclined from the hole of the green to the trough at the periphery of the green;

the bottom of the trough has a continuous downward inclination from at least one upper point to at least one lower point connected to the means for returning the balls to the starting head;

the means for returning the balls to the starting head comprise a conduit provided with a ball entrance orifice at the lower point of the trough located at the periphery of the green;

the installation further comprises at least one camera installed at a height in proximity to the green and connected to a receiving screen located in the vicinity of the starting head;

the installation includes a control device in proximity to the starting head, connected to the ball recovering device, to the camera and to the screen, and optionally a green selector and means for working out a score.

BRIEF DESCRIPTION OF THE DRAWINGS

The invention will be described in more detail hereinafter with reference to the accompanying drawings which are given solely by way of example and in which:

FIG. 1 is a plan view of a golf practicing green according to the invention;

FIG. 8 is a diagrammatic sectional view of another embodiment of a green according to the invention.

DETAILED DESCRIPTION OF THE INVENTION

Figure 2:
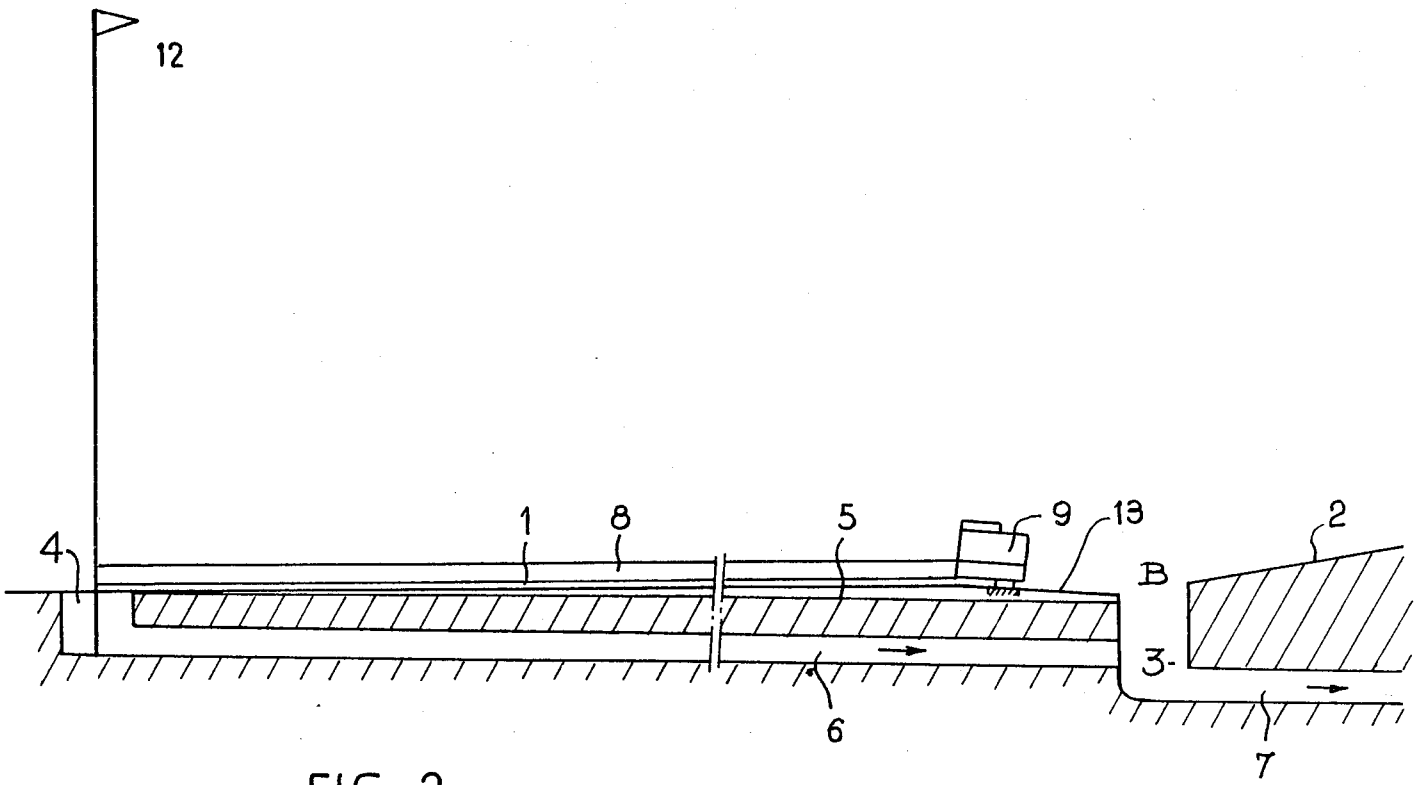
FIG. 2 is a sectional view taken on line 2—2 of FIG. 1.

Shown in FIG. 1 is a green 1 of circular shape, substantially planar, surrounded by a ground 2 which downwardly slopes toward the green. The green is separated from the surrounding ground by a circular trough 3 whose width exceeds the diameter of a golf ball. A radial trough 5 extends from a hole 4 at the center of the green to the circular trough 3. A pipe 6 for discharging balls which have dropped into the hole 4 extends under the green between the hole 4 and the circular trough 3. However, this pipe is not indispensable.

The circular trough 3 has an upper point shown by reference character A and the bottom of the trough is downwardly inclined in a continuous manner toward a lower point B. Extending from this point B is a pipe 7 connected to a device 44 for returning the balls to a starting head or position. The device 44 may be constructed in any suitable manner, e.g. as:

an inclined conduit returning the balls under the effect of gravity to a point in the vicinity of the starting head, in which case elevating means may be provided for raising the balls to the level of the starting head if necessary;

a conduit associated with pneumatic or hydraulic suction-producing means;

mechanical means of the conveyor belt or scoop conveyor type.

Extending radially from the hole 4 of the green is a rake 8 whose free end is connected to a driving carriage 9 (FIG. 2) which rolls on a circular rolling track 10 extending annularly of the green. In its position of rest, the rake overlies at least a part of the trough 5. Circular concentric bands 11, each having for center the hole 4 of the green, extend over the surface of the green 1.

The ground 2 surrounding the green 1 has for example a regular slope toward the circular trough 3. Ground 2 may include obstacles imitating, for example, bunkers also provided with orifices 40 and conduits 41 for recovering the balls which have fallen into such bunkers.

With reference to FIG. 2, it can seen that the green 1 includes a flag 12 placed in the hole 4. Preferably, the trough 5 is located opposite the region in which the players are placed for playing their strokes so as to occupy a blind angle defined by the staff of the flag 12. Furthermore, the trough 3 is spaced outwardly away from the periphery of the green, the region 13 between the periphery of the green and the trough 3 sloping downwardly from the green to the trough 3.

Figure 3:
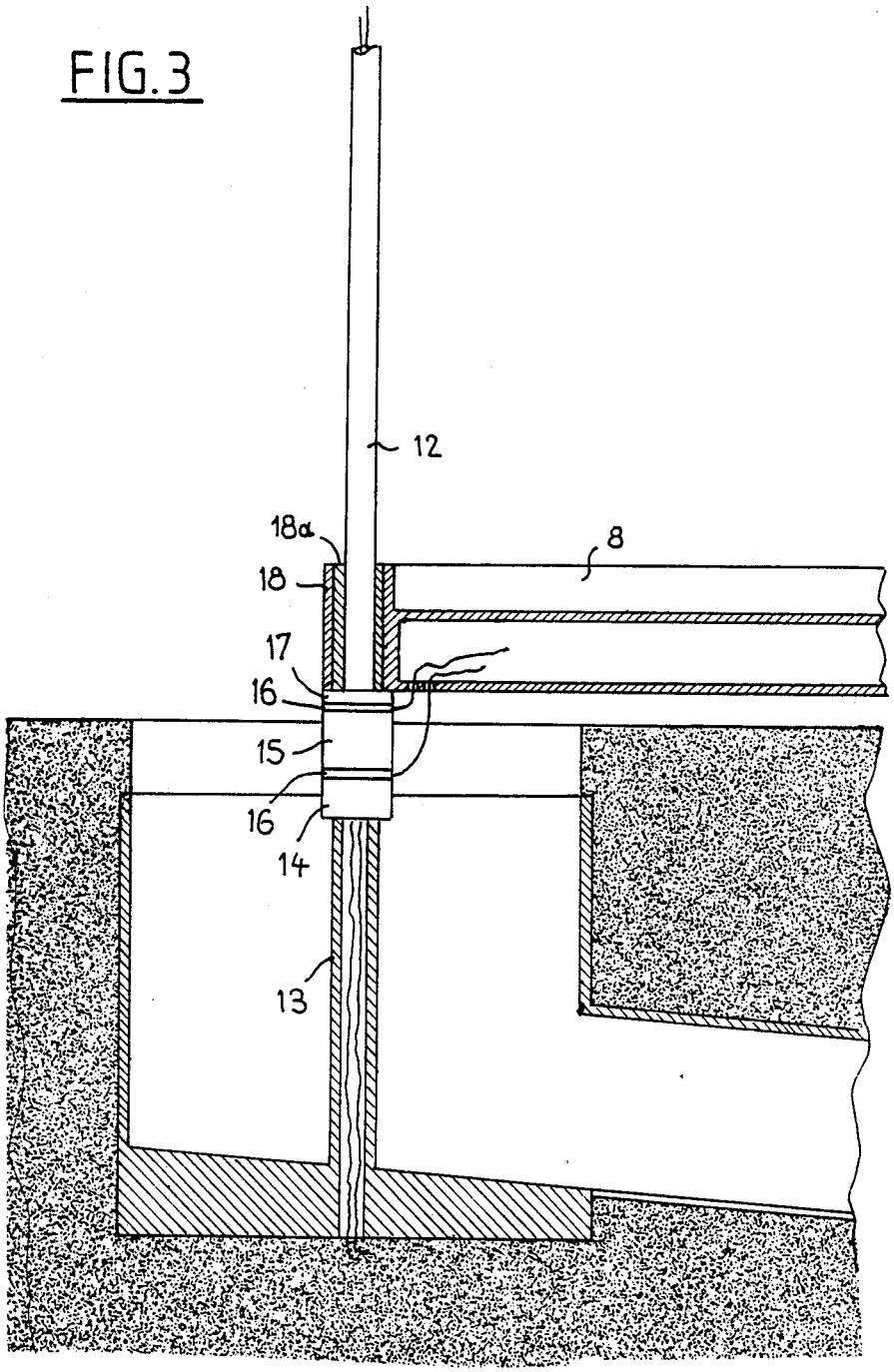
FIG. 3 is a sectional view to an enlarged scale in the region of the hole of the green.

The staff of the flag 12 is carried by a vertical tube (see FIG. 3) located at the center of the hole 4. Screwthreadedly engaged on this central tube are a lower ring 14 and an upper ring 15 of Teflon (trademark). Each of these rings has on its outer surface a copper ring 16 whose function will be explained hereinafter. Placed above the upper ring 15 is a metal wear ring 17. The rake 8 is connected at its central end relative to the green to a cylindrical sleeve 18 which surrounds the staff of the flag 12 and bears against the wear ring 17. Preferably, this sleeve is provided with an antifriction material 18*a* so as to rotate without friction around the staff of the flag 12.

Figure 5:
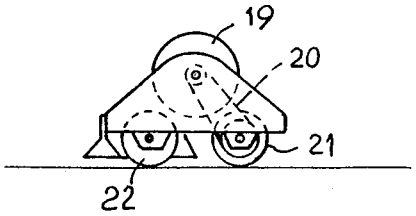
FIG. 5 is a side elevational view of the device shown in FIG. 4.
Figure 4:
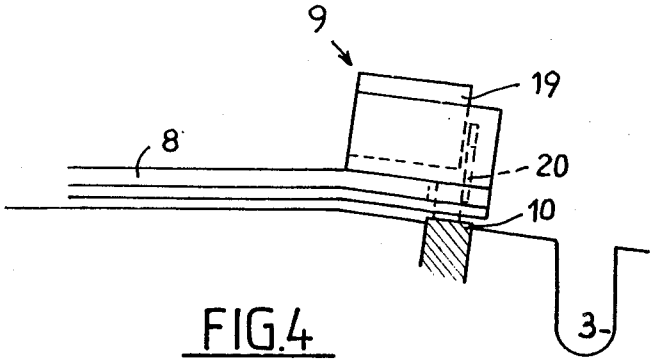
FIG. 4 is a front elevational view of a rake driving device.

The other end of the rake 8 is provided with driving carriage 9 having an electric motor 19 which drives through a belt 20 or other transmission means a driving wheel 21. The carriage 9 is also provided with a second wheel 22 (see FIGS. 4 and 5). The two wheels 21, 22 roll along the rolling track 10 and drive the rake 8 in a circular motion about its axis of rotation. Known means (not shown) are provided for actuating the motor only during a period corresponding to a complete rotation of the rake. These means may for example comprise an electromagnetically controlled switch placed in the supply circuit of the motor 19 and closed when it is desired to shift the rake. After a complete rotation of the latter, suitable means cause a mechanical opening of the switch and consequently the cutting off of the supply of the motor.

Figure 6:
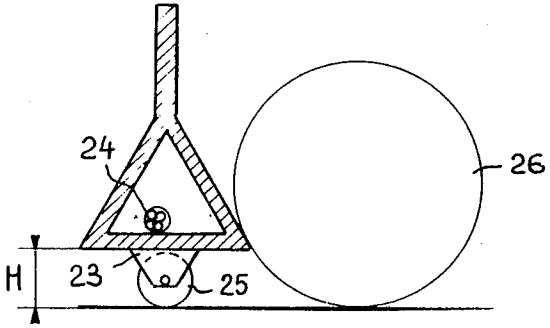
FIG. 6 is a sectional view of a first embodiment of a rake.

According to the illustrated embodiment, the rake 8 has in its lower part a cross-section in the shape of an isosceles triangle having an apex pointing upwardly. The base of this triangular section (see FIG. 6) may include intermediate supports 23 provided with wheels preferably bearing on the bands 11. Extending within this triangular section of the rake is a supply cable 24 for the motor 19. The base of the triangular section is at a height H from the ground which is distinctly less than the diameter of a golf ball 26.

Figure 7:
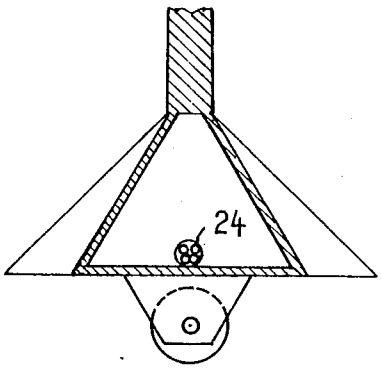
FIG. 7 is a view similar to FIG. 6 of another embodiment of the rake.

In a modification shown in FIG. 7, the triangular section of the rake is not uniform but decreases from the base of the rake to its free end.

In an embodiment of the invention shown in FIG. 8, the installation comprises a second circular trough 26 which is lower than the circular trough 3 and located between two slopes 42 and 43 which converge toward this second trough 26.

Figure 9:
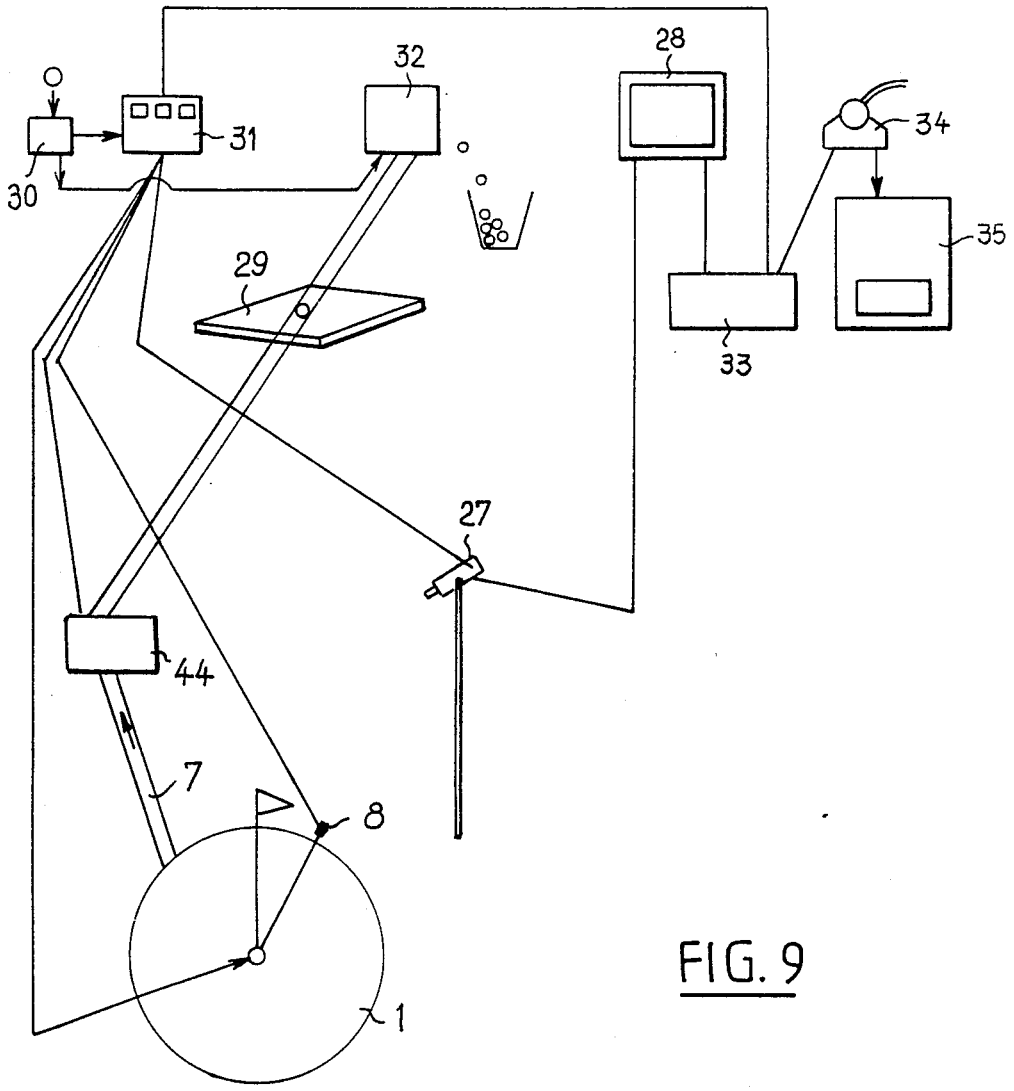
FIG. 9 is a schematic view of an installation according to the invention and its control device.

The installation further comprises a camera 27 in proximity to the green and above the latter, this camera being connected to at least one screen 28 in proximity to the starting head 29 (see FIG. 9). The camera is for example carried by a mast and is orientable if a plurality of greens must be covered. Also in proximity to the starting head 29 is a control device comprising an actuating apparatus 30 requiring the insertion of coins, tokens, magnetic cards or other means. This apparatus is well-known in the art and has not been shown in detail. The control device also includes means 31 for selecting a target, in the present instance a green, and a ball distributor 32. The control device is connected to the motor 19 and optionally to a light signal for facilitating the location of the hole, and ball return means 44.

The screen 28 is connected to a computer 33 which is associated with a printer 34 which compiles a score card 35.

A player who wishes to play or practice golf with an installation such as that shown in FIG. 9, must possess tokens, coins or a magnetic card to bring into operation the actuator 30. This actuator connects the whole of the installation to the power supply. The player then selects, as the case may be, the green on which he will play. The actuator actuates the ball distributor 32 which delivers for example twenty balls marked in a characteristic manner. This marking may be formed by a color, a reference or some design on the surface of the balls.

The player places the first ball on the starting head 29 and plays his first stroke in the direction of the hole of the selected green. If the ball lands on the ground surrounding the chosen green, this ball will roll into a trough 3 or 26 owing to the slope of the surrounding ground 2. If the ball reaches the green and stays thereon, its position will appear on the screen 28. This position is located by means of the bands 11 which define circular regions on the green. The player can therefore ascertain in a precise manner whether the ball is too long, too short, on the right or on the left. If the ball drops into the hole 4, it is immediately discharged through the pipe 6 to the ball returning device 44. The player can see on the screen 28 that his ball has directly entered the hole 4. Sound means or a flashing signal may moreover be provided for indicating this success. The same player or another player can then play another stroke. When each of the players has used all of the balls supplied to him by the distributor, the computer indicates the position of the balls of each of the players on the screen and allocates to them, in accordance with their position, a certain number of points, these points being printed on the card 35 by the printer 34. Upon this printing, the computer delivers to the control device a signal which causes the actuation of the rake 8 for sweeping across the surface of the green and bringing the balls to the radial trough 5. Under the effect of gravity, the balls will reach the circular trough 3 and will reach the ball distributor through the return pipe 7 and the device 44.

When it rotates, the rake pushes a certain number of balls on the green directly toward the circular trough 3.

In another embodiment of the invention, the computer is adapted to form on the screen 28 and image which is superimposed on that provided by the camera 27 and corresponds to the shape of a chosen green. In this case, the image of the green is so centered that the two holes are coincident. The image produced by the computer may also define regions each of which corresponds to score. It is consequently possible to project the image of the greens of famous golf courses or more simply the shape of the greens of a neighboring golf course. For this purpose it is sufficient that the required data be stored in the memory of the computer. Thus, the player will have the impression of practicing on this special green.

The described installation affords many advantages:

an initiation or a training in the game of golf may be rendered more attractive by the drawing up of scores which may moreover take into account handicaps which the players enter into the control device;

it allows an automatic operation in particular as concerns the recovery of the balls, which is also an advantage from the point of view of security;

the players can ascertain, without moving, the position of their balls, even if they are at a great distance from the hole they are playing;

the use of a computer permits a simulation of the shapes and of the surrounding of very varied greens and renders the game still more attractive;

this installation is not very complicated and does not involve very high investment costs so that it should become profitable.

Note also that many modifications may be evisaged without departing from the scope of the invention, for example:

the installation may include a training device comprising a motor speed-reducer unit driving the rake in rotation about the axis of the hole of the green; the motor speed-reducer unit may be located in a cavity under the green in proximity to the vertical axis of the hole; in this modification, the output shaft of the motor speed-reducer unit is connected to the inner end of the rake for driving the latter in rotation;

the installation may merely consist of the ball recovering means on and in the vivinity of the green;

it may be completed by a camera and screen system;

it may be more elaborate, as described hereinbefore, with the use of a computer for recognizing the balls on the image, calculating the scores, producing on the screen images of greens and the immediate environment (bunkers, water obstacles, etc.), taking handicaps into account, or actuating a printer, etc.;

many modifications may also be made in the realization of the means employed in this installation and in particular of the means for recovering and returning the balls; also the location of a hole at the center of the green is not essential.

I claim:

1. An installation for the game and the practicing of golf, said installation comprising:

at least one means defining a tee area and at least one means defining a green having a periphery and provided with a hole having an axis;

a device for recovering balls located on said green and in the vicinity of said green;

means for returning recovered balls to said tee area;

said ball recovering device comprising a rake extending radially from said axis of said hole in a direction substantially parallel to the surface of said green, said rake being mounted at an inner end thereof to be rotatable about an axis coincident with said axis of said hole so as to pass over the entire area of said green as said rake rotates, said rake having a lower edge at a distance from said surface of said green which is less than the diameter of a ball used in said game of golf, and said rake having at least partly a cross section in the shape of a triangle having an apex pointing upwardly, said rake thus defining a tube;

a rolling track adjacent said green;

at least one rolling member carried by said rake in the vicinity of a radially outer end thereof and rollingly bearing on said rolling track;

means for driving said rake for rotation about said axis thereof over said surface of said green; and means for receiving balls shifted by said rake.

2. An installation according to claim 1, further comprising a second rolling track, and at least one other rolling member carried by said rake at an intermediate point of the length thereof and bearing on said second rolling track.

3. An installation according to claim 2, wherein one of said rolling members is a driving member drivenly connected to said driving means.

4. An installation according to claim 2, wherein said means for receiving balls comprises a radial trough provided in said green.

5. An installation according to claim 4, wherein said radial trough extends on the side of said hole of said green opposite said tee area, and the bottom of said radial trough is continuously downwardly inclined from said hole to the periphery of said green.

6. An installation according to claim 1, wherein said rake driving means comprises a carriage connected to said rake, provided with wheels and carrying an electric motor drivingly connected to at least one of said wheels, electric supply conductors for said motor extending along said rake, and electric supply means in the region of said axis of rotation of said rake connected to said supply conductors.

7. An installation according to claim 6, wherein said electric supply conductors extend through said tube defined by said rake.

8. An installation according to claim 1, wherein said driving means bears on a rolling track located outside said green and offset in height relative to said rake.

9. An installation according to claim 1, wherein said driving means is located in a cavity in the vicinity of said axis of said hole and below the level of said green.

10. An installation according to claim 1, wherein said means for receiving balls comprise at least one trough located at the periphery of said green and a discharge pipe which is downwardly inclined from said hole of said green to said trough located at the periphery of said green.

11. An installation according to claim 10, wherein said trough has a bottom which is continuously downwardly inclined from at least one upper point of said bottom to at least one lower point of said bottom, and said means for returning balls to said tee area is connected to said lower point of said bottom of said trough.

12. An installation according to claim 11, wherein said means for returning balls to said tee area comprises at least one conduit connected to said lower point of said bottom of said trough located at the periphery of said green, a distributor station and feed means for bringing returned balls to said distributor station.

13. An installation according to claim 1, further comprising a control device located in proximity to said tee area and connected to said rake driving device.

14. An installation according to claim 13, further comprising at least one camera installed at a height in proximity to said green and connected to a receiving screen located in the vicinity of said tee area, said control device being connected to said camera and said screen for controlling the operation thereof.

15. An installation according to claim 14, comprising means for drawing up a score.

16. An installation according to claim 15, wherein the means for drawing up a score comprise balls marked in a characteristic manner.

17. An installation according to claim 15, wherein the means for drawing up a score comprise regions which constitute a target and are marked on said green.

18. An installation according to claim 14, comprising means for drawing up a score which comprise a computer connected to said screen and programmed for recognizing the image of balls on said screen and allocating a score thereto.

19. An installation according to claim 18, wherein said computer is effective to display on said screen images superimposed on the image of said green and forming a target.

20. An installation according to claim 18, further comprising a printer connected to said computer and adapted to compile a score card.

21. An installation according to claim 13, wherein said control device comprises at least one actuating means having an inlet for receiving tokens, coins, magnetic cards or any other suitable means for bringing said actuating means into action.

22. An installation according to claim 1, wherein the triangular cross section of said rake decreases from said inner end thereof to said outer end thereof.

* * * * *